US009333404B2

(12) United States Patent
Abbott et al.

(10) Patent No.: US 9,333,404 B2
(45) **Date of Patent: *May 10, 2016**

(54) CUSTOMIZABLE GOLF CLUB HEAD

(71) Applicant: CALLAWAY GOLF COMPANY, Carlsbad, CA (US)

(72) Inventors: Craig E. Abbott, Vista, CA (US); William C. Watson, Temecula, CA (US); Wee Joung Kim, Vista, CA (US); Bradley C. Rice, Carlsbad, CA (US); Irina Ivanova, Carlsbad, CA (US); Catherine Brookshire, Escondido, CA (US); Scott Manwaring, Carlsbad, CA (US)

(73) Assignee: CALLOWAY GOLF COMPANY, Carlsbad, CA (US)

( * ) Notice: Subject to any disclaimer, the term of this patent is extended or adjusted under 35 U.S.C. 154(b) by 167 days.

This patent is subject to a terminal disclaimer.

(21) Appl. No.: 14/280,159

(22) Filed: May 16, 2014

(65) Prior Publication Data

US 2014/0248975 A1 Sep. 4, 2014

Related U.S. Application Data

(63) Continuation of application No. 13/484,100, filed on May 30, 2012, now Pat. No. 8,753,225, which is a continuation-in-part of application No. 13/407,424, filed on Feb. 28, 2012, now Pat. No. 8,758,165.

(51) Int. Cl.

| | |
|---|---|
| ***A63B 53/04*** | (2015.01) |
| ***A63B 53/06*** | (2015.01) |
| ***A63B 59/00*** | (2015.01) |

(52) U.S. Cl.

CPC ..... *A63B 59/0092* (2013.01); *A63B 53/0466* (2013.01); *A63B 53/06* (2013.01); *A63B 59/0074* (2013.01); *A63B 60/52* (2015.10); *A63B 2053/0491* (2013.01); *A63B 2209/10* (2013.01)

(58) Field of Classification Search

CPC .... A63B 59/0074; A63B 53/06; A63B 60/52; A63B 2053/0491; A63B 59/0092; A63B 53/0466; A63B 2053/0433; A63B 2209/10; F16B 37/14

USPC ..... 473/334–339; 411/431, 372.5, 372.6, 411/373, 13

See application file for complete search history.

(56) References Cited

U.S. PATENT DOCUMENTS

| | | | | | |
|---|---|---|---|---|---|
| 4,052,075 | A * | 10/1977 | Daly | A63B 53/08 | 473/338 |
| 4,423,874 | A * | 1/1984 | Stuff, Jr. | A63B 69/3685 | 473/338 |
| 5,154,424 | A * | 10/1992 | Lo | A63B 53/04 | 473/338 |
| 7,407,447 | B2 * | 8/2008 | Beach | A63B 53/0466 | 473/324 |
| 7,410,426 | B2 * | 8/2008 | Willett | A63B 53/0466 | 473/334 |
| 8,257,196 | B1 * | 9/2012 | Abbott | A63B 53/0466 | 473/335 |
| 8,753,225 | B1 * | 6/2014 | Abbott | A63B 59/0074 | 473/334 |
| 8,758,165 | B1 * | 6/2014 | Abbott | A63B 53/0466 | 473/334 |
| 2006/0089206 | A1 * | 4/2006 | Lo | A63B 53/04 | 473/334 |

* cited by examiner

*Primary Examiner* — Sebastiano Passaniti

(74) *Attorney, Agent, or Firm* — Rebecca Hanovice; Michael Catania; Sonia Lari

(57) ABSTRACT

A golf club having features that permit easy customization by consumers is disclosed herein. The golf club includes at least one weight port, at least one removable weight port insert, which may be a weight port ring or one or more weight port medallions, and at least one weight screw. The weight port of the golf club head preferably is non-circular and asymmetric.

19 Claims, 7 Drawing Sheets

CUSTOMIZABLE GOLF CLUB HEAD

CROSS REFERENCES TO RELATED APPLICATIONS

The present application is a continuation of U.S. patent application Ser. No. 13/484,100, filed on May 30, 2012, which is a continuation-in-part of U.S. patent application Ser. No. 13/407,424, filed on Feb. 28, 2012, the disclosure of which is hereby incorporated by reference herein in its entirety.

STATEMENT REGARDING FEDERALLY SPONSORED RESEARCH OR DEVELOPMENT

Not Applicable

BACKGROUND OF THE INVENTION

1. Field of the Invention

The present invention relates to a golf club head having features that can be adjusted by golfers to customize the golf club head to better suit their tastes or weighting needs, or to improve the visibility of the golf club on a golf course. More specifically, the present invention relates to a golf club head having a replaceable ribbon band and/or one or more replaceable weight port inserts that can be exchanged for other ribbon bands and weight port inserts.

2. Description of the Related Art

Customization of consumer products in general, and golf club equipment in particular, has become more popular in recent years. Manufacturers are seeking new ways to design golf clubs and golf balls that appeal to the individualized tastes of their consumers. These manufacturers may offer golf equipment in different colors or designs, but once the customer purchases his or her equipment, no further customization is possible without a significant expenditure of time, expense, and expertise. As such, there is a need for a golf club head having features that permit golfers to easily customize various qualities of the golf club head.

BRIEF SUMMARY OF THE INVENTION

The present invention relates to an easily customizable golf club head. One aspect of the present invention is a golf club head comprising a sole comprising at least one weight port, a ribbon comprising at least one elongate recess, at least one weight port ring, and at least one elongate insert, wherein the at least one weight port ring fits within the at least one weight port, and wherein the at least one elongate insert fits within the at least one elongate recess.

In some embodiments, the at least one weight port ring and the at least one elongate insert may be composed of a lightweight material. The at least one weight port ring may be retained within the at least one weight port with an adhesive material, and the at least one elongate insert may also be retained within the at least one elongate recess with an adhesive material, which may be semi-permanent. In further embodiments, the at least one weight port ring may be removably received within the at least one weight port, and the at least one elongate insert may also be removably received within the at least one elongate recess. The elongate recess may be disposed in an aft region of the ribbon, and the sole may comprise two weight ports and one elongate recess. In a further embodiment, the golf club head may comprise at least one weight screw, wherein the at least one weight screw is received within the at least one weight port, and wherein the weight port ring is disposed between the sides of the weight port and the weight screw.

Another aspect of the present invention is a driver-type golf club head comprising a face, a crown, a sole comprising at least one weight port, the at least one weight port comprising a shallow recess and a threaded bore, a ribbon connecting the crown to the sole, the ribbon comprising an aft region having an elongate recess, at least one weight screw comprising a head and a threaded extension, the head sized to fit within the shallow recess, and the threaded extension sized to fit within the threaded bore, at least one weight port ring sized to fit within the weight port recess, and an elongate insert sized to fit within the elongate recess, wherein the at least one weight port ring and the elongate insert are composed of a lightweight material, wherein the at least one weight port ring is removably affixed within the weight port recess with a semi-permanent adhesive material, wherein the elongate insert is removably affixed within the elongate recess with a semi-permanent adhesive material, and wherein the at least one weight port ring is disposed between at least one wall of the shallow recess and the head of the weight screw.

In some embodiments, the at least one weight port ring may comprise a cylindrical wall and a shelf portion disposed perpendicular to the cylindrical wall, the shelf portion rests against a bottom surface of the at least one weight port, and the cylindrical wall rests against a side surface of the at least one weight port. In these embodiments, the adhesive material may be disposed on an external surface of the cylindrical wall and a lower surface of the shelf portion. In other embodiments, the at least one weight screw may not make contact with any portion of the at least one weight port ring. In yet other embodiments, the at least one weight port ring and the elongate insert may each be composed of a polymeric material, and the at least one weight screw may be composed of at least one metal material.

Yet another aspect of the present invention is a kit comprising a golf club head comprising a sole, a ribbon, a crown, and a face, at least one shallow recess disposed on at least one of the sole, ribbon, and crown, and a plurality of inserts sized to fit within the at least one shallow recess, wherein each of the plurality of inserts has a color that differs from the color of the other inserts, and wherein each of the plurality of inserts is composed of a lightweight material. Each of the plurality of inserts may have an external surface comprising a semi-permanent adhesive material, and may have a density that differs from the density of the other inserts. In some embodiments, the at least one shallow recess may be a weight port and the plurality of inserts may weight port rings, which may be a polymeric material. In other embodiments, the at least one shallow recess may be an aft ribbon elongate recess and the plurality of inserts may be elongate inserts sized to fit within the elongate recess and may be composed of a polymeric material.

Another aspect of the present invention is a golf club head comprising a sole comprising at least one non-circular weight port, a first medallion comprising a through-bore, a second medallion comprising a through-bore sized to receive the first medallion, and at least one weight screw, wherein the weight port comprises a threaded bore, a side wall, and a base, wherein the weight screw comprises a threaded extension sized to engage the threaded bore, wherein the second medallion is affixed within the weight port with an adhesive material, wherein the weight screw is removably received within the weight port, and wherein the first medallion is disposed between the weight screw and the second medallion. In some embodiments, the weight port may be asymmetric or polygonal. The threaded bore may be integrally formed with the weight port, or may be a separate piece that is affixed to the weight port by any means known to one of skill in the art. The weight screw may retain the first medallion within the weight port, or the weight screw may not make any contact with the first medallion or the second medallion. In some embodiments, the first medallion is affixed within the weight port with an adhesive material. The weight screw may be made of multiple materials, such as a non-metal material and a metal material.

In some embodiments, the first medallion may be composed of a first material having a first density, the second medallion may be composed of a second material having a second density, and the first material may be different from the second material. In further embodiments, the first material is a non-metal material such as a polymer and the second material is a metal material such as a metal alloy. In alternative embodiments, the first material is a metal material, and wherein the second material is a non-metal material. In some embodiments, the golf club head is a wood-type head having a volume of 150 to 500 cubic centimeters. In one embodiment of the invention, the adhesive material may be semi-permanent, and the second medallion may be removably received within the at least one weight port. In some further embodiments, the sole of the present invention may comprise a second weight port, which may be circular. The weight port may be integrally formed in the sole, or the sole may comprise a cutout portion and the non-circular weight port may be affixed to the sole to cover the cutout. In some embodiments, the sole may be composed of a composite material, and the weight port may be integrally formed in the sole.

Another embodiment of the present invention is a driver-type golf club head comprising a sole comprising at least one non-circular weight port, a medallion comprising a through-bore, and at least one weight screw, wherein the weight port is integrally formed in the sole, wherein the weight port comprises a threaded bore, a side wall, and a base, wherein the weight screw comprises a threaded extension sized to engage the threaded bore, wherein the first medallion is disposed between the weight screw and the side wall of the weight port and abuts the base of the weight port, and wherein the driver-type golf club head has a volume of at least 420 cubic centimeters and no more than 480 cubic centimeters.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
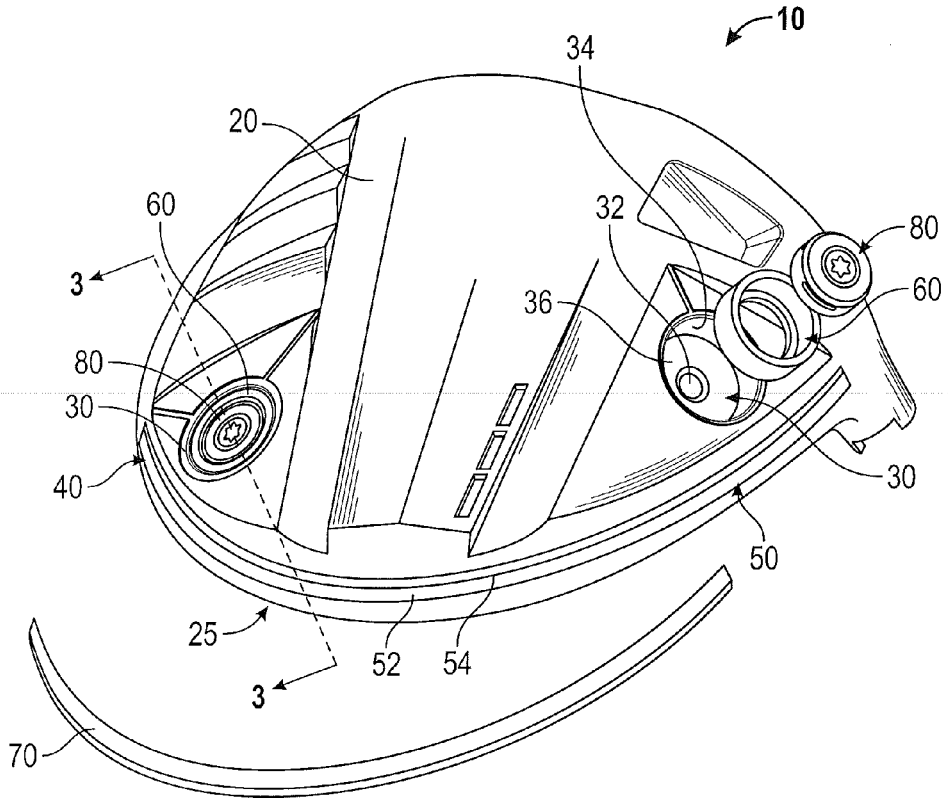
FIG. 1 is an exploded view of a first embodiment of the present invention.

The present invention allows golfers to customize features of their golf club heads using replaceable parts. The replaceable parts may have different visual features, such as coloration or design, or may have different weights or densities. The embodiments of the present invention may be used with any type of golf club head, including woods, hybrids, irons, and putters, though in the preferred embodiment the present invention is used in connection with a driver head 10 having a face (not shown), a crown (not shown), a sole 20, an aft end 25, one or more weight ports 30, and a ribbon or side edge 40 connecting the crown to the sole 20. The embodiments of the present invention may be provided to consumers as a kit, which may comprise a golf club head and numerous different customizable parts having different colors, features, weights, densities, and/or material compositions.

A first embodiment of the present invention is shown in FIGS. 1-4. A driver head 10 has two weight ports 30 in its sole 20 and an elongate, shallow recess 50 in an aft region 25 of its ribbon 40. Each weight port 30 includes a threaded bore 32, a side wall 34, and a base 36, and receives a weight screw 80 having a head 82 sized to fit within the weight port 30 and a threaded extension 84 sized to removably engage the threads of the threaded bore 32.

Figure 2:
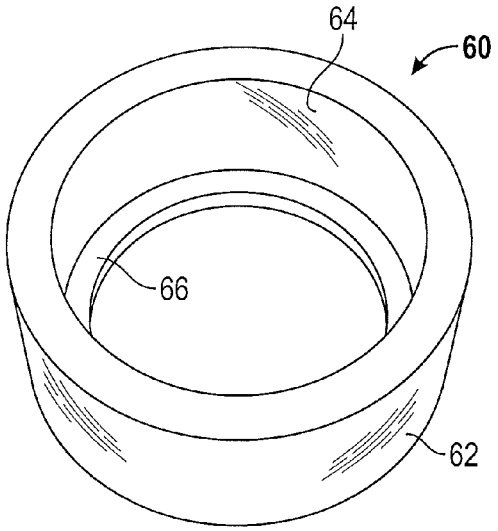
FIG. 2 is an enlarged view of the weight port ring shown in FIG. 1.
Figure 3:
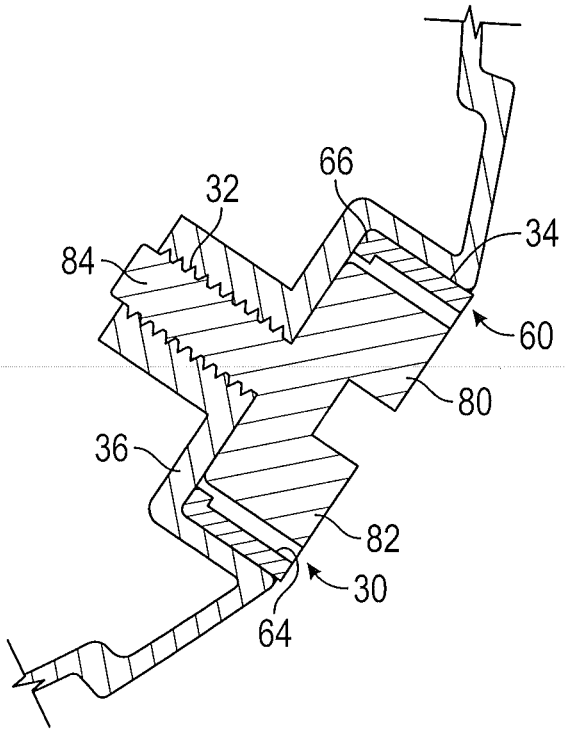
FIG. 3 is a cross-section view of the embodiment shown in FIG. 1 along lines 3-3.
Figure 4:
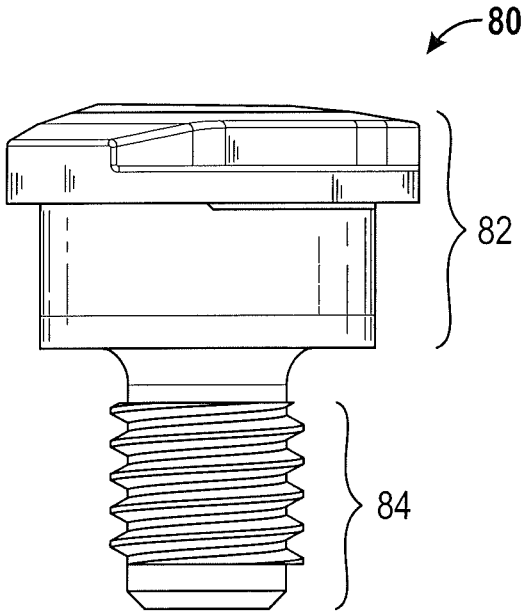
FIG. 4 is a side view of the weight screw shown in FIG. 1.

In addition to the weight screw 80, the weight port 30 is sized to receive a weight port ring 60, which preferably sits between the side wall 34 and the head 82 of the weight screw 80 without making contact with any portion of the weight screw 80. As shown in FIGS. 1, 2, and 3, the weight port ring 60 includes an exterior wall 64, which rests against the interior wall 34 of the weight port 30, an interior wall 62 that is preferably spaced from the weight screw 80 when the screw 80 is assembled in the weight port 30, and a shelf 66 that rests against the base 36 of the weight port 30. In this embodiment, the weight port ring 60 can be removed and replaced with a weight port ring 60 having different cosmetic features, different material compositions, different weights, or a combination of these elements. The exterior wall 64 of the weight port ring 60 thus preferably is coated with a semi-permanent adhesive material or adhesive tape that allows the weight port ring 60 to semi-permanently bond with the interior wall 34 of the weight port 30, but permits removal of the weight port ring 60 from the weight port 30 if enough force is applied.

The shallow recess 50 also has side walls 52 and a base 54, and is sized to receive an elongate ribbon insert 70, which preferably is removably fixed within the shallow recess 50. As described herein with respect to the weight port ring 60, at least one surface of the ribbon insert 70 is coated with a semi-permanent adhesive material that permits the ribbon insert to semi-permanently bond with the side walls 52 and/or base 54 of the shallow recess. Also, as with the weight port ring 60, the elongate ribbon insert 70 preferably can be removed and replaced with a ribbon insert 70 having different cosmetic features, different material compositions, different weights, or a combination of these elements.

In the first embodiment, the sole 20 is composed of a metal alloy material, and the weight ports 30 are integrally formed in the sole. In alternative embodiments, including those disclosed herein, the sole 20 and/or the weight ports 30 may be composed of a composite material, and have the structure and composition of one or more of the embodiments disclosed in U.S. patent application Ser. Nos. 13/248,855 and 13/363,551, the disclosure of each of which is hereby incorporated by reference in its entirety herein. The weight screws 80 preferably are formed of a single type of metal material, but in alternative embodiments may have any structure or material composition, including those disclosed in U.S. patent application Ser. No. 13/410,127, the disclosure of which is hereby incorporated by reference in its entirety herein.

Figure 5:
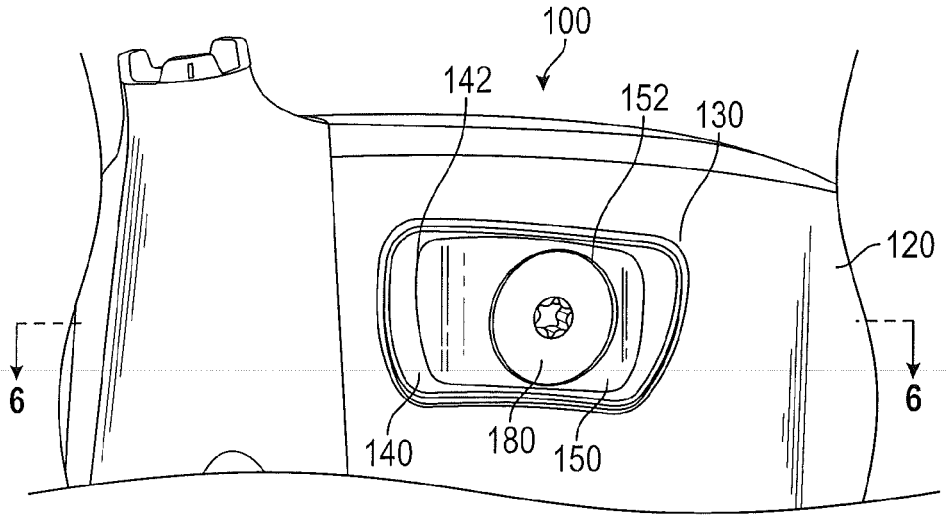
FIG. 5 is a perspective view of a second embodiment of the present invention.
Figure 6:
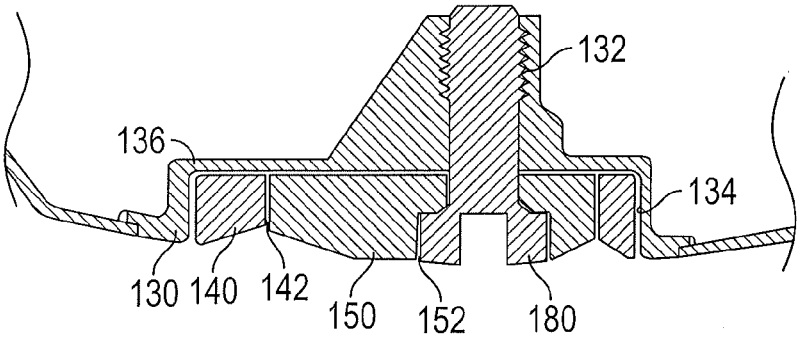
FIG. 6 is a cross-sectional view of the embodiment shown in FIG. 5 along lines 6-6.

A second embodiment is shown in FIGS. 5-6. As shown in these Figures, the golf club head 100 has a sole 120 with a non-circular weight port 130 which, in this embodiment, is substantially rectangular. In alternative embodiments, the weight port 130 may take the shape of any other polygon, or asymmetric, non-polygonal shapes. The weight port 130 includes side walls 134, a base 136, and a threaded bore 132 sized to receive a threaded extension portion 184 of a weight screw 180. The head 182 of the weight screw 180 in this embodiment is significantly smaller than the area of the weight port 130.

Instead of a weight port ring 60, the golf club head 100 of the second embodiment includes several weight port medallions 140, 150, which preferably are larger and take up more space within the weight port 130 than the weight port ring 60. In this embodiment, the golf club head 100 includes an outer medallion 140 and an inner medallion 150, both of which encircle the threaded bore 132 and thus the weight screw 180 when it is fully disposed within the weight port 130. The outer medallion 140 has a bore 142 sized to receive the inner medallion 150 without making direct contact with the inner medallion 150. The outer medallion 140 preferably is fixed within the weight port 130 with an adhesive, which may be semi-permanent to allow golfers to remove and replace the medallion 140.

The inner medallion 150 fits within the bore 142 of the outer medallion 140 when the outer medallion 140 is disposed within the weight port 130. The inner medallion 150 also includes a bore 152, which aligns with the threaded bore 132 of the weight port 130. In the embodiment shown in FIGS. 5 and 6, the inner medallion 150 is retained within the weight port 130 with the weight screw 180, which may, in alternative embodiments, be exchanged for a standard screw. The inner medallion 150 may also be retained within the weight port 130 with an adhesive, which may be semi-permanent to allow a golfer to remove or exchange the inner medallion 150.

Figure 7:
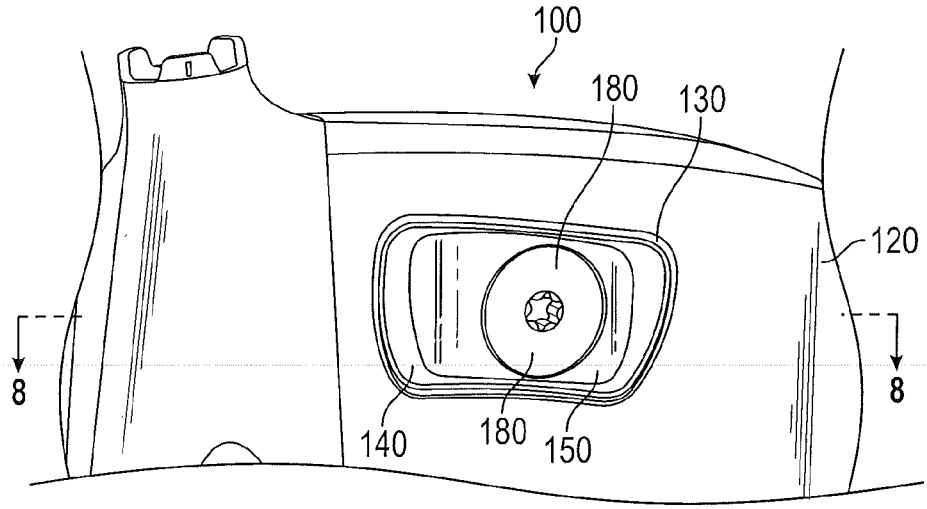
FIG. 7 is a perspective view of a third embodiment of the present invention.
Figure 8:
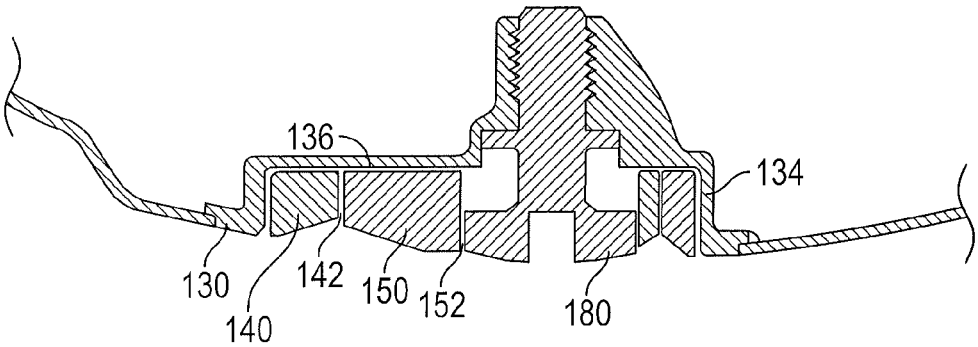
FIG. 8 is a cross-sectional view of the embodiment shown in FIG. 7 along lines 8-8.

The embodiment shown in FIGS. 7 and 8 is similar to the one shown in FIGS. 5 and 6, in that it includes a golf club head 100 with an asymmetric, non-circular weight port 130 in the sole 120 that houses two medallions 140, 150. In this embodiment, however, neither medallion 140, 150 is retained within the weight port 130 with the weight screw 180. Instead, each medallion 140, 150 is retained within the weight port 130 with an adhesive, which may be semi-permanent to allow golfer customization of the club head 100. The adhesive may be applied to any surface of the medallions 140, 150 that contact the walls 134 or base 136 of the weight port 130. In some embodiments, the medallions 140, 150 may also be bonded together by the adhesive.

Embodiments of the golf club head 200 of the present invention having only one medallion 240 are shown in FIGS. 9-14. In the embodiment shown in FIGS. 9 and 10, the golf club head 200 comprises a non-circular weight port 230 in its sole 220. The weight port comprises curved sidewalls 234 and a base 236, and is sized to receive the medallion 240. A boss 250 is affixed to the weight port to provide a threaded bore 252 to receive the threaded extension portion 282 of the weight screw 280. In alternative embodiments, however, the threaded bore 252 is integrally formed with the weight port. The medallion 240 has a bore 242 that aligns with the threaded bore 232 of the weight port 230 and is sized to receive a weight screw 280. The medallion 240 is retained within the weight port 230 with an adhesive, which may be semi-permanent, and the medallion 240 preferably does not make contact with the weight screw 280 when the embodiment is fully assembled.

Figure 9:
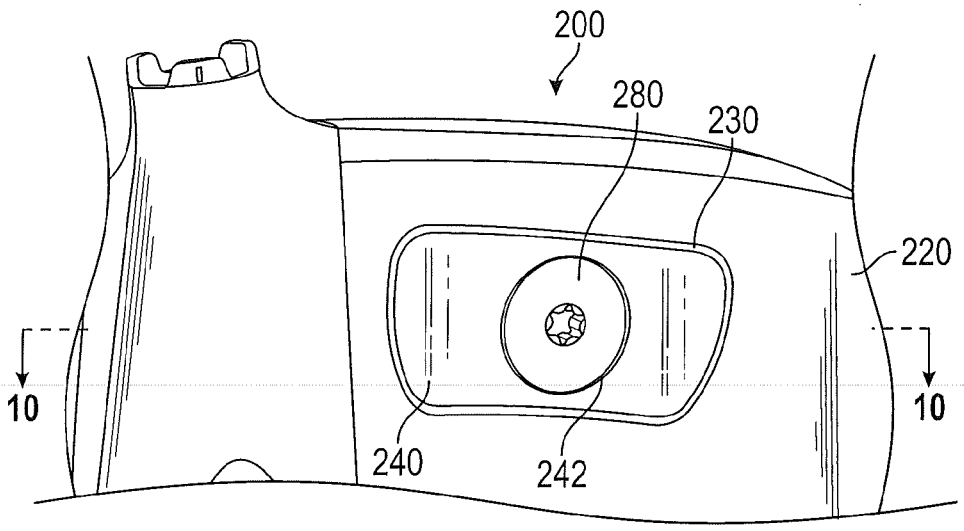
FIG. 9 is a perspective view of a fourth embodiment of the present invention.
Figure 10:
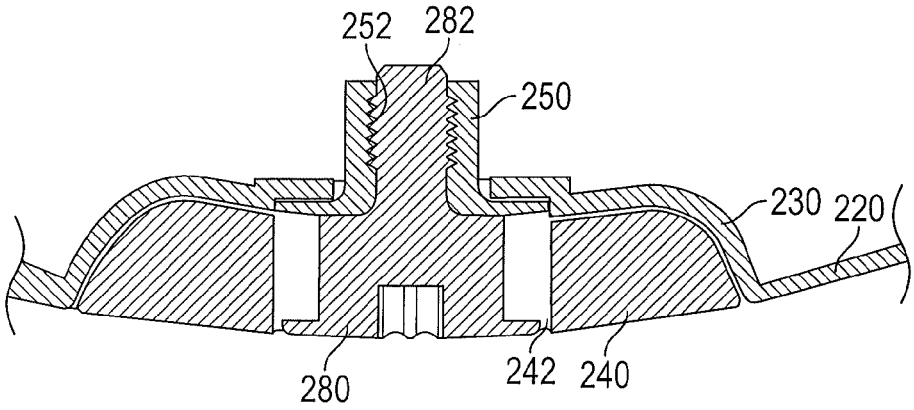
FIG. 10 is a cross-sectional view of the embodiment shown in FIG. 9 along lines 10-10.
Figure 11:
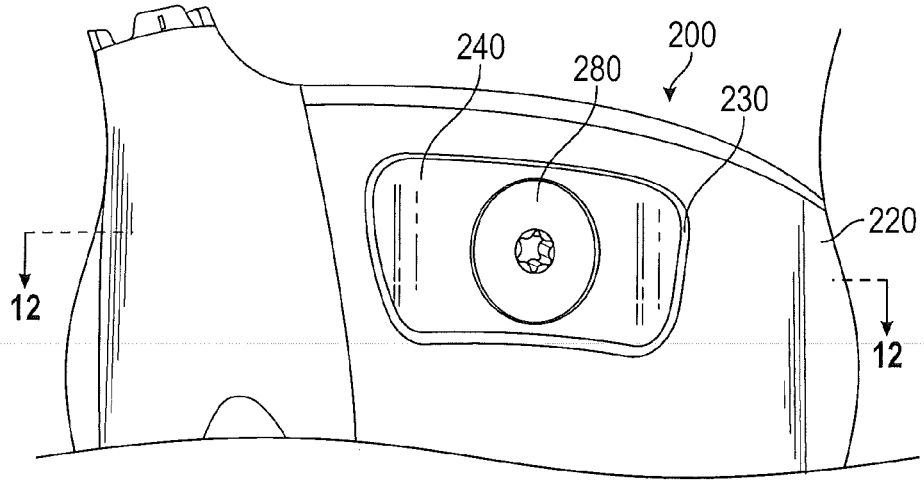
FIG. 11 is a perspective view of a fifth embodiment of the present invention.
Figure 12:
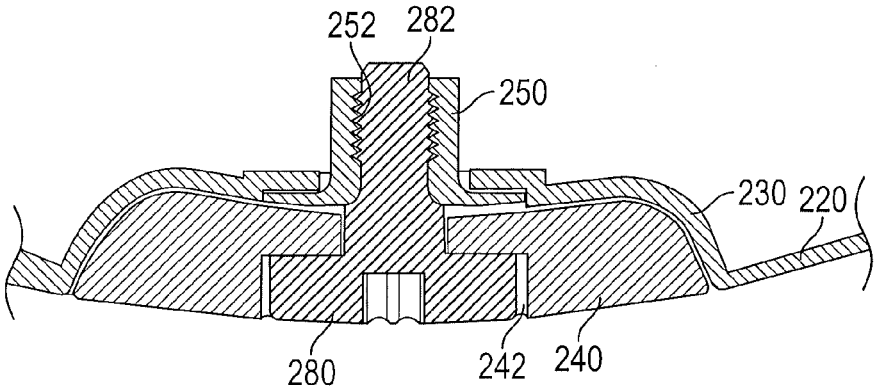
FIG. 12 is a cross-sectional view of the embodiment shown in FIG. 11 along lines 12-12.
Figure 13:
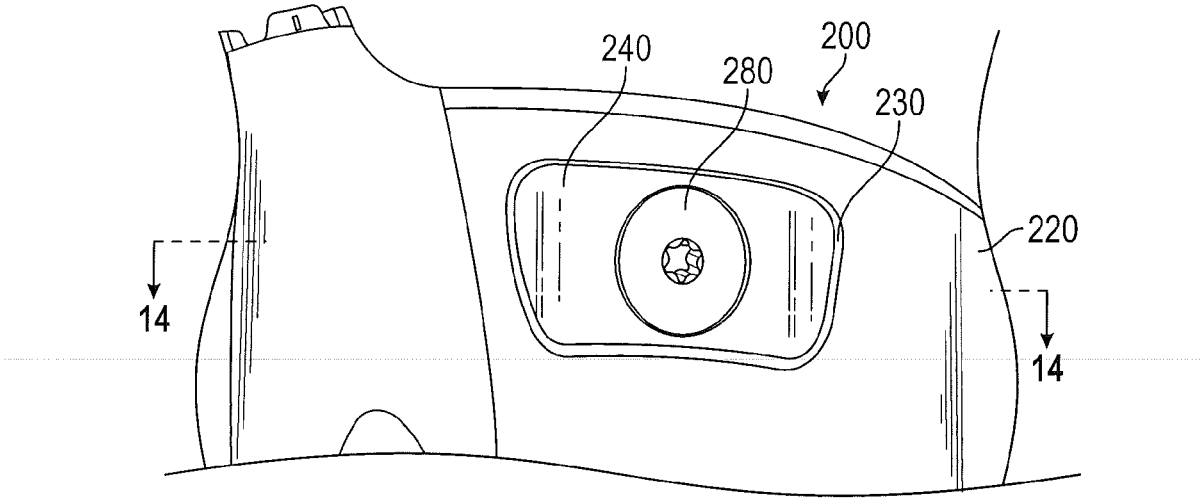
FIG. 13 is a perspective view of a sixth embodiment of the present invention.
Figure 14:
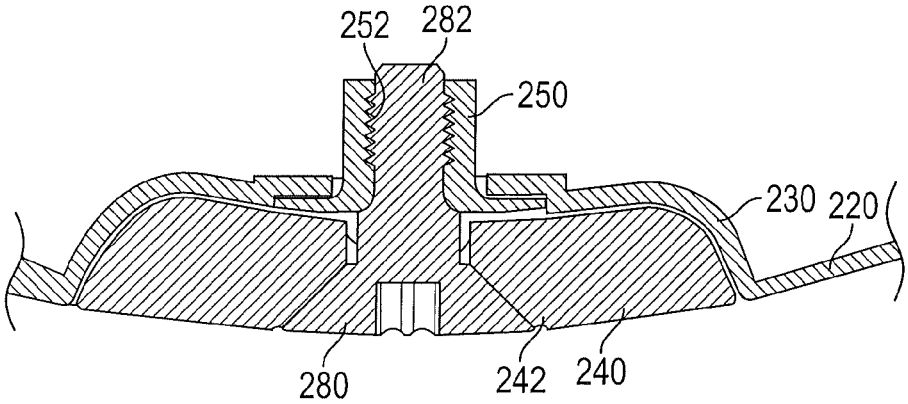
FIG. 14 is a cross-sectional view of the embodiment shown in FIG. 13 along lines 14-14.

The embodiments shown in FIGS. 11, 12, 13, and 14 include the same parts as the embodiment shown in FIGS. 9 and 10, but the medallion 240 in these embodiments is retained within the weight port by the weight screw 280 or, in alternative embodiments, a non-weighted fastener. In particular, the weight screw 280 used in connection with the embodiment shown in FIGS. 13 and 14 press-fits the medallion 240 into the weight port 230. In alternative embodiments, the weight port 230 may include any of the boss 250 configurations disclosed in U.S. patent application Ser. No. 13/363,551.

For each embodiment of the invention that employs adhesive to retain a medallion 140, 150, 240 within a weight port 130, 230, the adhesive may be composed of an adhesive tape, which may provide semi-permanent adherence to permit users to remove and replace the medallions 140, 150, 240 within the weight port 130, 230. The adhesive tape can also function as a sound dampening agent to prevent unwanted sound that can be caused by the medallions 140, 150, 240 during use of the golf club head 100, and may include a rubber or foam material that acts as a sound dampener.

In alternative embodiments, the golf club head 100 of the present invention may comprise a combination of circular and non-circular weight ports 30, 130, which may receive any combination of medallions 140, 150, weight port rings 60, and weight screws 80 disclosed herein. The embodiments disclosed herein may be made of any number of materials, including those material compositions disclosed in U.S. Pat. Nos. 6,244,976, 6,332,847, 6,386,990, 6,406,378, 6,440,008, 6,471,604, 6,491,592, 6,527,650, 6,565,452, 6,575,845, 6,478,692, 6,582,323, 6,508,978, 6,592,466, 6,602,149, 6,607,452, 6,612,398, 6,663,504, 6,669,578, 6,739,982, 6,758,763, 6,860,824, 6,994,637, 7,025,692, 7,070,517, 7,112,148, 7,118,493, 7,121,957, 7,125,344, 7,128,661, 7,163,470, 7,226,366, 7,252,600, 7,258,631, 7,314,418, 7,320,646, 7,387,577, 7,396,296, 7,402,112, 7,407,448, 7,413,520, 7,431,667, 7,438,647, 7,455,598, 7,476,161, 7,491,134, 7,497,787, 7,549,935, 7,578,751, 7,717,807, 7,749,096, and 7,749,097, the disclosure of each of which is hereby incorporated in its entirety herein. For example, in some embodiments, the head 10 may be integrally cast from a metal alloy such as titanium.

In other embodiments, only the sole, face, and ribbon are composed of a metal alloy and the crown is formed of a composite material. The composite material may be formed using one or more of the techniques described in U.S. Patent Publication Nos. 20100139079 and 20110065528, and U.S. patent application Ser. No. 12/886,773, the disclosure of each of which is hereby incorporated by reference in its entirety herein. The other pieces of the invention may also be composed of any type of material. For example, the weight port ring 60 and the ribbon insert 70 may be made of a lightweight metal alloy, a polymeric material such as plastic or rubber, and/or a composite material. In alternative embodiments, these pieces may be composed of one or more metal alloys.

In some embodiments, the medallions 140, 150, 240 may have any material composition, and preferably have different cosmetic features, material compositions, weights, or a combination of these elements. For example, the outer medallion 140 may be composed of a lightweight, non-metal material, while the inner medallion 150 may be composed of a denser, metal material. The material density of the medallions 140, 150, 240 may range from under 1 g/cc to 17 or more g/cc. In such embodiments, the medallions 140, 150, 240 may be used by golfers to adjust overall golf club weighting and appearance. In further embodiments, each of the medallions 140, 150, 240 may be composed of multiple materials, such that opposing ends of the medallions 140, 150, 240 have different densities. In such embodiments, the center of gravity of a golf club head 100 can be adjusted by rotating the medallions 140, 150, 240 within the weight ports 130, 230 to reverse the orientation of the opposing ends.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A kit comprising:

a golf club head having at least one weight port;

at least one weight screw sized to fit within the at least one weight port; and a plurality of inserts, each of the plurality of inserts composed of a lightweight material and sized to fit within the at least one weight port, wherein the plurality of inserts comprises a plurality of outer medallions and a plurality of inner medallions, wherein each of the plurality of outer medallions comprises a through-bore sized to receive one of the plurality of inner medallions, and wherein there is no contact between the at least one weight screw and one of the plurality of inserts when the at least one weight screw and the one of the plurality of inserts are disposed within the at least one weight port.

2. The kit of claim 1, wherein each of the plurality of inserts comprises an external surface comprising a semi-permanent adhesive material.

3. The kit of claim 1, wherein each of the plurality of inserts has a density that differs from the density of each of the other inserts.

4. The kit of claim 1, wherein each of the plurality of inserts has a color that differs from the color of each of the other inserts.

5. The kit of claim 1, wherein each of the plurality of inserts is a weight port ring.

6. The kit of claim 5, wherein each of the weight port rings is composed of a polymeric material.

7. The kit of claim 5, wherein each of the weight port rings comprises a cylindrical wall and a shelf portion disposed perpendicular to the cylindrical wall.

8. The kit of claim 7, wherein an exterior surface of the cylindrical wall of each of the weight port rings comprises a semi-permanent adhesive material.

9. The kit of claim 8, wherein the semi-permanent adhesive material is an adhesive tape.

10. The kit of claim 1, wherein at least one of the plurality of inserts is asymmetric.

11. The kit of claim 1, wherein at least one of the plurality of inserts is polygonal.

12. The kit of claim 1, wherein each of the outer and inner medallions is affixed within the weight port with an adhesive material.

13. The kit of claim 12, wherein the adhesive material is an adhesive tape.

14. The kit of claim 13, wherein the adhesive tape comprises a sound dampening material selected from the group consisting of rubber and foam.

15. The kit of claim 1, wherein each of the plurality of outer medallions is composed of a first material having a first density, wherein each of the plurality of inner medallions is composed of a second material having a second density, and wherein the first density is different from the second density.

16. The kit of claim 15, wherein the first material is a non-metal material, and wherein the second material is a metal material.

17. The kit of claim 15, wherein the first material is a metal material, and wherein the second material is a non-metal material.

18. The kit of claim 1, wherein the at least one weight screw comprises a metal material and a non-metal material.

19. The kit of claim 1, wherein the at least one weight screw is composed of one metal material.

* * * * *

UNITED STATES PATENT AND TRADEMARK OFFICE

CERTIFICATE OF CORRECTION

PATENT NO. : 9,333,404 B2
APPLICATION NO. : 14/280159
DATED : May 10, 2016
INVENTOR(S) : Craig E. Abbott et al.

It is certified that error appears in the above-identified patent and that said Letters Patent is hereby corrected as shown below:

On the title page, in (73) Assignee, replace "Calloway Golf Company" with "Callaway Golf Company"

Signed and Sealed this
Twenty-third Day of August, 2016

Michelle K. Lee

Michelle K. Lee
*Director of the United States Patent and Trademark Office*